United States Patent [19]

Houot

[11] 3,983,708

[45] Oct. 5, 1976

[54] METHODS AND APPARATUS FOR PLACING UNDERWATER GUIDE LINES

[75] Inventor: Georges Sylvain Houot, La Garde, France

[73] Assignee: Schlumberger Technology Corporation, New York, N.Y.

[22] Filed: June 30, 1975

[21] Appl. No.: 591,675

[30] Foreign Application Priority Data

July 2, 1974 France ..... 74.22967

[52] U.S. Cl. ..... 61/114; 166/.5; 166/.6

[51] Int. Cl.[2] ..... F16L 1/00; E21B 33/35

[58] Field of Search ..... 61/72.3, 72.1, 69; 166/.5, .6

[56] References Cited

UNITED STATES PATENTS

| | | | |
|---|---|---|---|
| 3,696,864 | 10/1972 | Brown | 166/.5 |
| 3,795,114 | 3/1974 | Cremiers et al. | 61/69 |
| 3,851,492 | 12/1974 | Cannon | 61/72.3 |

*Primary Examiner*—Jacob Shapiro

*Attorney, Agent, or Firm*—David L. Moseley; William R. Sherman; Stewart F. Moore

[57] ABSTRACT

Methods and apparatus are disclosed herein for placing a guide line or cable on an underwater well installation connection point in a case where there is already in place a connection line between the surface and the water bottom. By means of a self-carrying electric cable, a vehicle is lowered along the connection line, the vehicle being equipped with a drum on which is wound the guide line having a connector fixed to one end and held vertically on the vehicle. Near the underwater connection point, the vehicle is made to rotate around the connection cable in order to bring the connector into alignment with the connection point. The connector then is engaged with the connection point by allowing the vehicle to further descend, after which the vehicle is raised along the connection line by pulling on the self-carrying electric cable, causing the guide line to unwind from the drum, thereby bringing an end of the line to the surface.

16 Claims, 4 Drawing Figures

METHODS AND APPARATUS FOR PLACING UNDERWATER GUIDE LINES

This invention relates to methods and apparatus for attaching guide lines or cables to an underwater well installation, and more particularly to methods and apparatus for so connecting a guide line or cable in a case where a connection cable is already available between the surface and a location near the connection point.

In many cases in which it is desired to reach an object, such as an underwater well head, located on the sea floor from a ship, it is necessary to place, between this object and the surface, two guide cables intended to guide the lowering and the raising of equipment. By contrast, when such operations are not carried out, it is preferable not to leave any connection between the surface and the well head.

There are known techniques making it possible to store a guide cable on the ocean floor and to bring the free end of this cable to the surface when desired. One of these techniques, described for example in the U.S. application Ser. No. 432,126, assigned to the assignee of this invention, comprises an immersed buoy kept on the sea floor by means of an anchoring assembly and equipped with a drum on which is wound the guide cable. During operations on the well head, the anchoring assembly is freed by an acoustic remote-control signal and the buoy rises to the surface while unwinding its cable. At the end of the operations, it is possible to rewind the cable on a drum by means of a removable electric motor and thereby bring the buoy back to its immersion point. Unfortunately, such a technique is not suited for the placing of several guide cables presently required for reaching the well head without any possible uncertainty because it is obviously desirable to leave only a minimum of epuipment inactive at the bottom of the ocean and exposed to corrosion for long periods of time.

It is therefore an object of the present invention to provide new and improved methods and apparatus for placing a second guide cable to an underwater connection point when a first one already is in place, without the need for underwater workers.

According to the invention, a method for placing a guide cable on an underwater connection point employs a vehicle on which is stored the guide cable and which carries, attached to the end of the guide cable, an automatic connector designed to engage on the underwater connection point. In this method, the carrying vehicle is lowered along the connection cable already in place, and the vehicle is made to turn around the connection cable when it is in the vicinity of the connection point to bring the connector opposite this connection point. The vehicle then is lowered along the guide cable in order to engage the connector on the connection point, after which the vehicle is raised along the connection cable by unwinding the guide cable in order to bring its other end back to the surface. At least during the lowering of the carrying vehicle, the azimuth of this vehicle around the connection cable is kept substantially constant.

An apparatus for placing a guide cable according to the present invention comprises a chassis, means for guiding the chassis along the connection cable, and means for storing a guide cable on the chassis adapted to allow this cable to unwind when traction is applied to it. A guide cable carried by cable storage means and including an end equipped with a connector is adapted to engage on the underwater connection point, with means being provided for maintaining the connector on the chassis. A motor means is adapted to rotate the chassis around the connection cable to give the chassis a particular angular orientation to enable the connector to be engaged with the underwater connection point, after which the chassis is raised to the surface, paying the guide cable out behind.

Preferably, the cable storage means includes a drum rotatably mounted on the chassis and on which is wound the guide cable, and a torque limiter associated with the drum to give the guide cable a predetermined tension when it is unwound and payed out from the drum. The means for raising the chassis to the surface comprises a self-carrying electric cable fixed to the chassis and capable of being wound on a surface winch. The chassis also carries a position detection assembly made up, for example, of a compass in order to note the angular position of the chassis around the connection cable, and means, preferably a television camera, for noting the position of the underwater connection point. The means for engaging the connector on the underwater connection point comprises a stopping device to maintain the chassis in an immersed position immediately over the underwater connection point, and means are provided which is controlled from the surface for freeing the stopping device and allowing the chassis to be lowered below this position.

For a better understanding of the invention, together with further features and advantages thereof, reference will be made to the following description in connection with the appended drawings in which.

Figure 1:
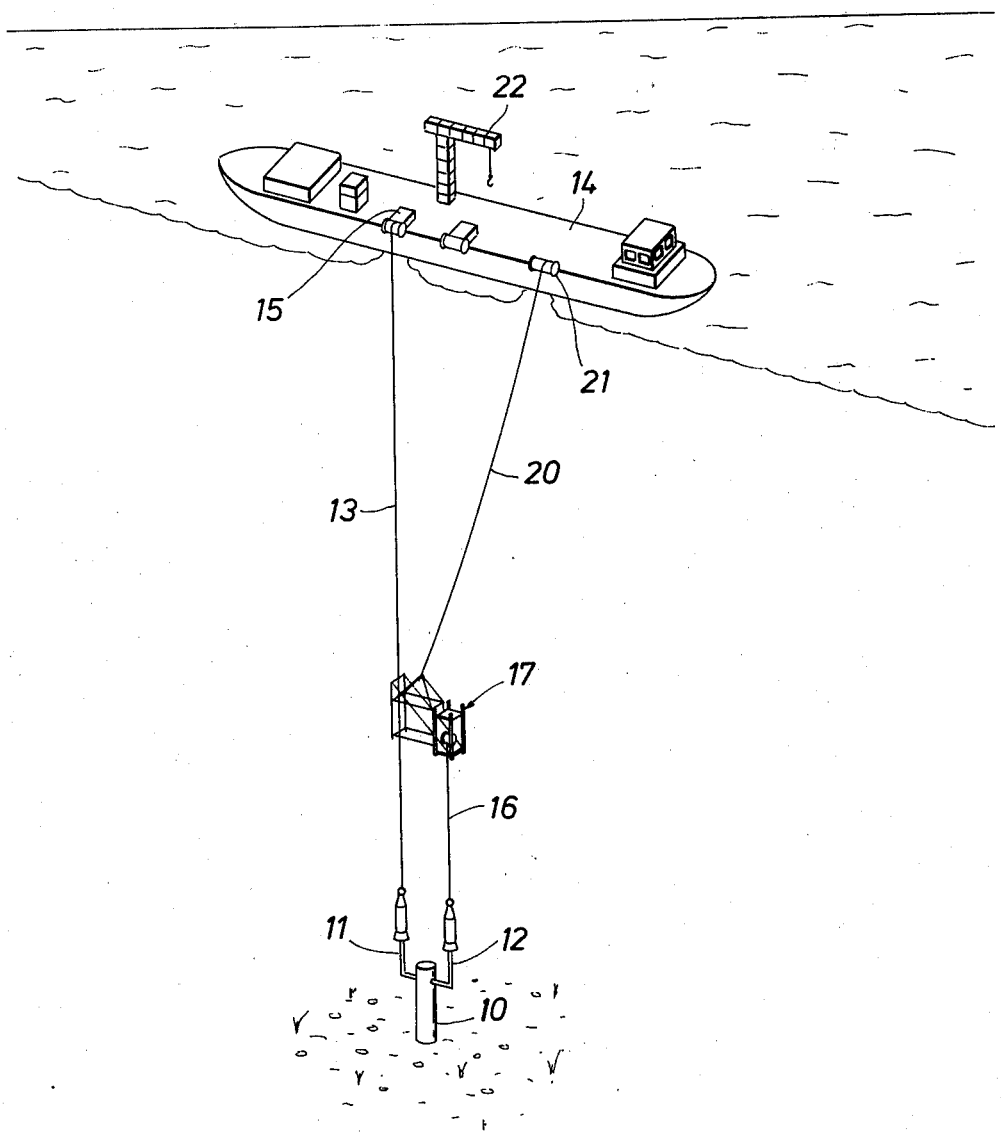
FIG. 1 is a schematic representing the placing of a guide cable in accordance with the invention.

Referring to FIG. 1, an underwater well head 10 is equipped with guide cable connection points 11 and 12. A first guide cable 13 already is in place, and referred to herein as the connection cable, links the well head 10 to an operations ship 14. The connection cable 13 has been previously installed, for example, and maintained at the bottom of the ocean by means of a buoy of the type described in the previously-mentioned patent application. When the ship 14 arrives near the well head 10, the connection cable 13 is recovered and is tensioned between the connection point 11 and a winch 15 on the ship. The method and apparatus of the present invention make it possible to install a guide cable 16 between the connection point 12 and the ship 14. This apparatus comprises in general a carrying vehicle 17 which is moved along the connection cable 13 by means of a self-carrying electric cable 20 which is wound on a winch 21. The ship 14 is equipped with a crane 22 which allows the vehicle 17 to be handled outside of the water.

Figure 2:
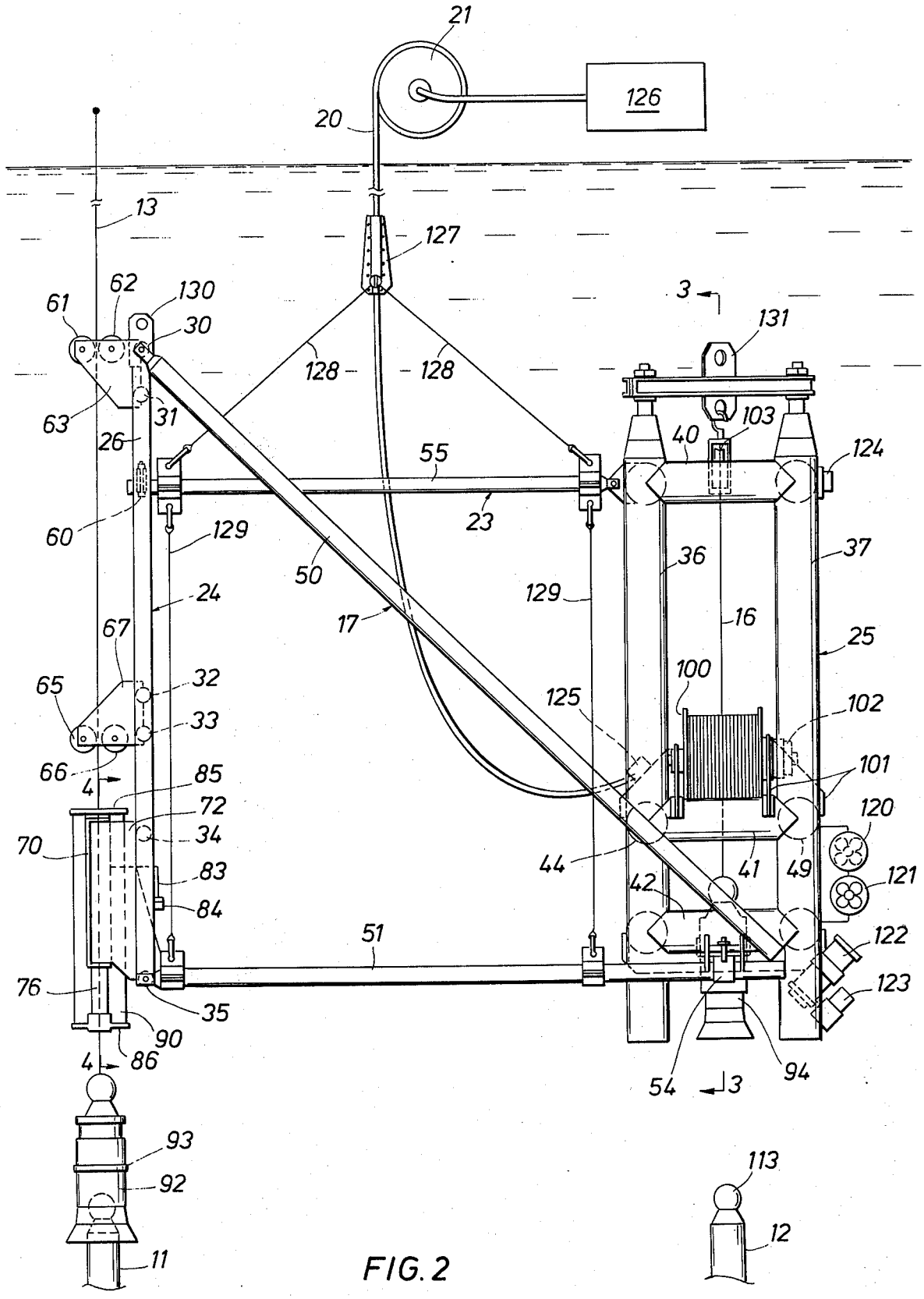
FIG. 2 is a view of an apparatus according to the invention for the placing of a guide cable.
Figure 3:
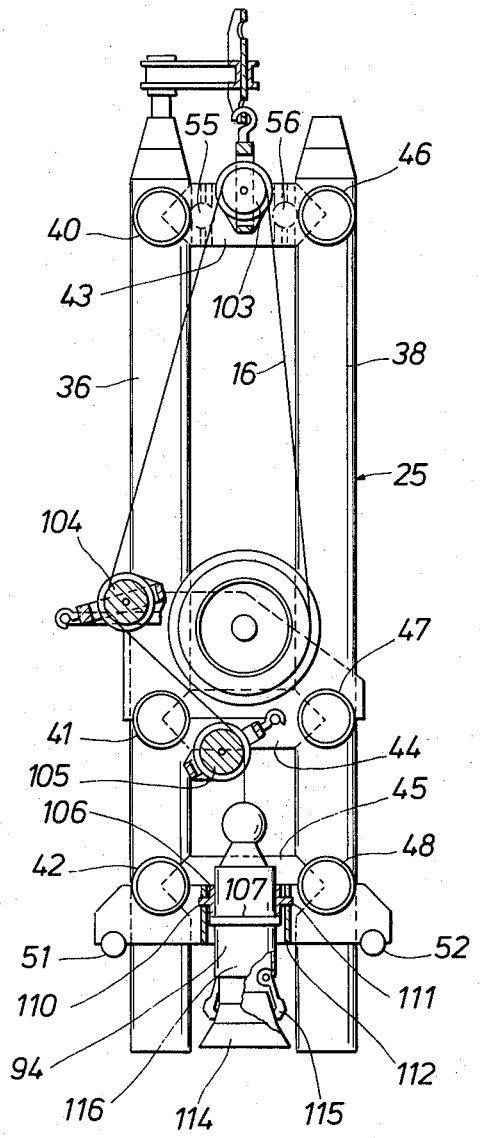
FIG. 3 is a section along the line 3—3 of FIG. 2.
Figure 4:
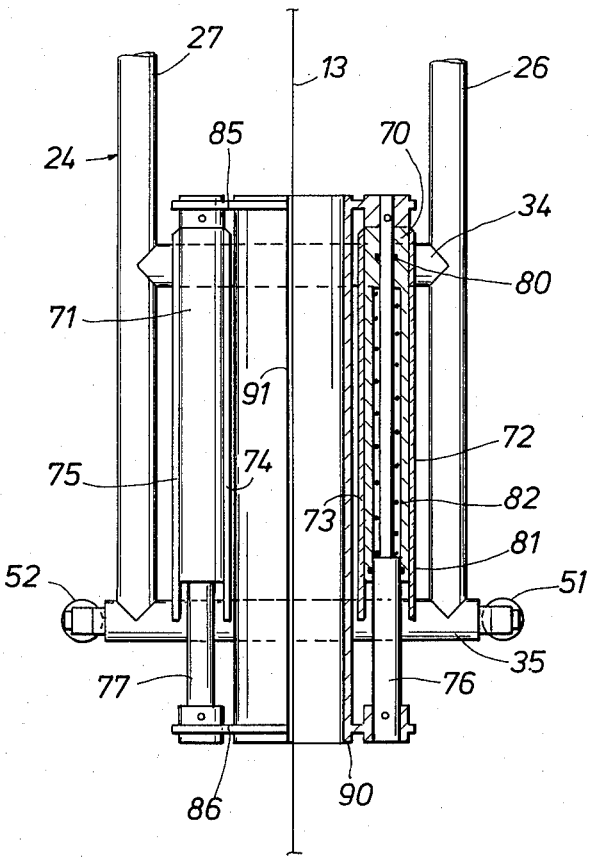
FIG. 4 is an enlarged partial section along the line 4–4 of FIG. 2.

The carrying vehicle 17, shown in greater detail in FIGS. 2 to 4, comprises a chassis 23 of adjustable size made up of a metallic frame 24 and of a cage 25 respectively located on the left and right in FIG. 2. The frame 24 (FIGS. 2 and 4) is made up of two vertical metallic tubes 26 and 27 braced by several transverse tubes 30, 31, 32, 33, 34 and 35. These tubes are hollow and non-sealed so that water can flow freely within them for reasons of non-resistance to pressure. The cage 25 (FIGS. 2 and 3) is made up of four vertical tubes such as 36, 37 and 38 in reinforced plastic spaced by twelve horizontal tubes also in plastic such as 40 to 48. These plastic tubes are closed and sealed and resist the ambient pressure of the seawater so as to give the carrying vehicle additional buoyancy.

At the upper and lower ends of the frame 24 are fixed respectively two oblique metallic tubes such as 50 and two horizontal tubes 51 and 52. The lower end of the tube 50 is welded to the tube 51 so as to form a rigid triangle, the horizontal tube 52 forming with another oblique tube a second triangle located in a plane parallel to the first. Between these two triangles, the cage 25 is fixed on the tubes 51 and 52 by means of clamping collars such as 54. The cage 25 is integral with two horizontal metallic tubes 55 and 56 to which is fixed the frame 24 by other clamping collars such as 60. By unscrewing the collars 54 and 60, it is possible to slide, on the one hand, the tubes 55 and 56 in relation to the frame 24 and, on the other hand, the tubes 51 and 52 in relation to the cage 25. It is thus possible to modify the distance between the frame 24 and the cage 25 in accordance with the distance between the guide cable connection points 11 and 12.

The chassis 23 comprises means for guiding the carrying vehicle 17 along the connection cable 13. At the upper part of the frame 24, two wheels 61 and 62 are mounted rotatably between brackets 63 fixed to the transverse tubes 30 and 31. On an intermediate part of the frame 24, two other wheels 65 and 66 are mounted rotatably on brackets 67 fixed to the transverse tubes 32 and 33. The brackets of each wheel system can be opened to allow the introduction of the connection cable 13.

At the lower part of the frame 24 is fixed a stopping device to hold the chassis in an immersed position located immediately over the connection points 11 and 12. This device, shown in FIGS. 2 and 4, comprises two cylinders 70 and 71 fixed to the transverse tubes 34 and 35 by means of supporting plates 72, 73, 74 and 75. Inside the respective cylinders 70 and 71 are slidably mounted two pistons 76 and 77, the sealing between each cylinder and its piston being achieved by seals such as 80 and 81. Inside the cylinder 70 is placed a spring 82 mounted in compression between this cylinder and shoulder of the piston 76 to drive the piston downward. An identical spring is mounted in the cylinder 71. The inside of the cylinders 70 and 71 communicates with the exterior via a line 83 (FIG.2) which ends in a solenoid valve 84 closed in the rest position.

The pistons 76 and 77 are connected solidly by two connection plates 85 and 86 respectively fixed to the upper and lower ends of the pistons. The plates 85 and 86 carry a sleeve 90 along the axis of which passes the connection 13; this cable can be introduced through a longitudinal slot 91. The inner diameter of the sleeve 90 is chosen so as to fit over a connector 92 that attaches the connection cable 13 to the connection point 11 without, however, exceeding a stop position bearing against a shoulder 93 of this connector. When the pistons 76 and 77 are in the low position, as shown in FIG. 4, and when the sleeve 90 is bearing against the shoulder 93, the carrying vehicle 17 is kept in a position slightly above the connection point 12. By contrast, if the pistons 76 and 77 are in the high position, a connector 94 attached to the end of the guide cable 16 fits on the connection point 12, as will be explained in further detail below.

Referring to FIGS. 2 and 3, the cage 25 comprises means for storing the guide cable 16 consisting of a drum mounted rotatably on a support 101 fixed on the horizontal tubes 41, 44, 47 and 49. The shaft of the drum 100 is integral with the torque limiter 102 which introduces a certain resistance to the rotation of this drum. The cable 16 which becomes the second or guide cable is wound on the drum 100 and runs over a set of pulleys 103, 104 and 105 fixed to the cage 25. The lower end of the cable 16 is attached to a connector 94 mounted in a collar 106 with a certain play; this collar can open for the introduction of the connector. The connector 94 is secured in this collar in the upper position by the tension of the cable due to the torque limiter 102, a shoulder 107 of the connector bearing against the lower face of the collar 106. The collar 106 is equipped with two transversely extending trunnions 110 and 111 mounted rotatably on a support 112 attached to the cage 25 so as to have a certain degree of rotational freedom in the plane of the chassis 23.

The connector 94 is adapted to hook automatically onto a spherical head 113 of the connection point 12 when it is fitted to this head. Schematically, this connector comprises a guide cone 114 which allows its introduction on the head 113, pivoted pawls 115 adapted to fall over the spherical head 113 and a blocking sleeve 116 which, in the low position, locks the pawls 115 on the head 113.

The cage 25 also carries two motors 120 and 121 (FIG. 2) equipped with propellers in order to turn the chassis 23 around the connection cable in one direction or the other. At the lower part of the cage 25 also is fixed a television camera 122 and a floodlight 123 positioned so as to allow observation of the area immediately under the connector 94. Finally, at the upper part of the cage is fixed a compass 124 capable of transmitting its information remotely. This compass is placed preferably at a point far from the metallic elements carried by the cage 25.

The self-carrying electric cable 20 is extended downward to a sealed connection box 125 from which lead out connections to the different electric apparatus such as the motors 120 and 121, the television camera 122, the floodlight 123, the compass 124 and the solenoid valve 84. By means of the cable 20, it is possible, from surface equipment 126, to supply current to the different electric components and to receive, on the surface, the information furnished by the compass 124 and the camera 122. A collar 127 fixed around the lower part of the cable 20 supports the chassis 23 by means of main slings 128 and auxiliary slings 129. In order to handle the carrying vehicle 17 outside of the water, gussets 130 and 131 fixed to the chassis 23 allow it to be held and lifted by means of the crane 22 located on board the ship.

In operation, the carrying vehicle 17 is stored dismantled on the ship. When ready to be used, the frame 24 and the cage 25 are assembled by means of the tubes 51–52 and 55–56 so that the spacing between the axis of the centering sleeve 90 and that of the connector 94 is equal to the known distance between the underwater connection points 11 and 12. The drum 100 is normally equipped with a sufficiently long cable. However, there is the possibility of having reserve drums equipped with cables of different lengths and, if necessary, the drum already installed can be replaced by another drum having a cable of suitable length. This replacement is facilitated by the fact that the pulleys 103, 104 and 105 have opening shells and that the collar 106 is made up of two parts to enable easy introduction of the cable. After having made and checked the connections between the cable 20 and the different electrical components, one assures that the elements of the module have the positions shown in FIG. 2, i.e., that the cylinders 70 and 71 are filled with water, the pistons 76 and 77 in the low position, the valve 84 closed and the cable 16 kept under tension by the torque limiter 102.

The connection cable 13 is then introduced into the centering sleeve 90 and between the wheels 61 and 62, on the one hand, and 65 and 66 on the other. The carrying vehicle 17 is then immersed by means of the crane 22 using the gussets 130 and 131.

In the immersed position, the carrying vehicle has a relatively low apparent weight and it can be held only by the self-carrying electric cable 20 after having freed it from the crane 22. From the outset, the azimuth of the vehicle 17 around the connection cable 13 is noted by means of the compass 124. The carrying vehicle 17 is then lowered by unwinding the winch 21. Throughout the lowering, the azimuth of the vehicle as given by the compass 124 is observed and one attempts to keep it constant by means of the motors 120 and 121. This operation is intended to prevent the winding of the cable 20 around the connection cable 13. Upon reaching the bottom, the cylinder 90 bears against the shoulder 93 of the connector 92 and stops the lowering of the vehicle 17. As the cylinders 70 and 71 are filled with water and the valve 84 is closed, the pistons 76 and 77 are secured in the lower position. On board the ship, slack is given to the cable 20 so that the movements of the ship due to waves are not transmitted to the vehicle 17.

The floodlight 123 is lit and observation takes place by means of the television screen located on the surface. There are two possibilities:

If the azimuth of the connection point 12 in relation to the connection point 11 is known, it is sufficient to rotate the vehicle 17 around the connection cable 13 by means of the motor 120 and 121 until its heading becomes equal to this azimuth. At this instant, the connection point 12 should be seen under the connector 94.

If the azimuth of this connection point 12 is not known, the television screen is observed and the vehicle is rotated until this connection point comes into the field of the camera 122.

When the connector 94 is immediately over and within the axis of the connection point 12, a signal is sent to open the solenoid valve 84. The inside of the cylinders 70 and 71 then communicate with the outside and, under the weight of the vehicle 17, the pistons 76 and 77 penetrate into their respective cylinders while compressing the springs 82. The connector 94 then comes over the spherical head 113 of the connection point 12 and automatically hooks onto this head. If, owing to poor aiming, the hooking does not take place, it is possible to begin the operation agains by slightly raising the vehicle by means of the cable 20 while keeping the valve 84 open. Under the effect of the springs 82, the pistons 76 and 77 come to the low position and it is then possible to close the solenoid valve again and rest the vehicle on the shoulder 93 of the connector 92. The alignment procedure for the connector 94 is then begun again with the connection point 12.

When the connector 94 is hooked on the head 113, the self-carrying cable 20 is wound on the winch 21 so as to raise the vehicle 17 to the surface. During this raising operation, the guide cable 16 unwinds from the drum 100, the torque limiter 102 maintaining a sufficient tension in this cable and allowing the vehicle 17 to remain substantially balanced in a horizontal position. During the raising operation, the heading of the vehicle 17 can be kept at a constant value if necessary. Upon reaching the surface, the vehicle is lifted from the water by means of the crane 22 and the cable 16 is unwound completely from the drum 100 so as to attach its end to a point on the ship. One then has two guide cables 13 and 16 and it is possible to work on the well head by means of known techniques using these guide cables.

Since the methods and apparatus just described permit of many modifications without departing from the concepts of the present invention, it is the aim of the appended claims to cover all such changes or modifications falling within the true spirit and scope of the present invention.

I claim:

1. A method for extending a guide line from a second underwater connection point to the water surface in a case where a connection cable already exists between the water surface and a first connection point near said second connection point, comprising the steps of: lowering into the water along said connection cable a vehicle carrying a guide line wound on a storage device, said guide line having an end equipped with a connector adapted to engage said second connection point; turning said vehicle around said connection cable when said vehicle is near said second connection point to bring the connector into vertical alignment with said second connection point; imparting to said vehicle a downward movement along the connection cable when said connector is alinged with said second connection point to engage said connector with said second connection point; and then raising said vehicle along said connection cable to cause said guide line to unwind from said storage device to bring an end of said guide line to the surface.

2. A method according to claim 1 further comprising the step of maintaining substantially constant the azimuth of said vehicle at least during its lowering along the connection cable.

3. Apparatus for extending a guide line from an underwater connection point to the water surface in a case where a connection cable already exists between the water surface and a location near said connection point, comprising: a chassis; means for guiding said chassis along said connection cable; means for storing a guide line on said chassis, said storing means being adapted to allow said guide line to unwind therefrom under the effect of traction; a guide line wound on said cable storing means and having its outer end fixed to a connector that is adapted to engage said connection point; means for positioning said connector on said chassis at a given lateral distance from said connection cable; motor means for orienting said chassis with respect to said connection cable in order to bring said chassis to a given angular position; means for engaging said connector with said connection point; and means for raising said chassis to the surface with said guide line being unwound from said storing means.

4. The apparatus of claim 3 wherein said cable storing means comprises a drum rotatably mounted on said chassis, said guide line being wound on said drum.

5. The apparatus of claim 4 wherein said drum is equipped with a torque limiter to give said line a predetermined tension while it is being unwound from said drum.

6. The apparatus of claim 3 wherein said means for raising the chassis to the surface comprises a self-carrying electric cable fixed to said chassis and adapted to be wound on a surface winch.

7. The apparatus of claim 6 further including a position detection assembly for giving a remote indication of the orientation of said chassis with respect to said connection cable.

8. The apparatus of claim 7 wherein said position detection assembly comprises a compass and transmission device for transmitting to the surface electric signals representative of the azimuth of said chassis.

9. The apparatus of claim 8 wherein said motor means is adapted to be controlled from the surface in response to signals from said position detection assembly to maintain the azimuth of the chassis around said connection cable substantially constant at least during its lowering along said connection cable.

10. The apparatus of claim 9 further including means fixed to said chassis for observing the position of said underwater connection point.

11. The apparatus of claim 10 wherein said means for observing the position of said underwater connection point comprises a television camera connected to the surface via a transmission cable.

12. The apparatus of claim 3 wherein said chassis comprises a buoyant part located opposite said connection cable to reduce the apparent weight in water of said part opposite said connection cable.

13. The apparatus of claim 12 wherein said means for positioning said connector on said chassis is adjustable in relation to said guide means so as to enable varying said distance between said connector and the connection cable.

14. The apparatus of claim 13 wherein said means for engaging said connector on said connection point comprises stop means for maintaining said chassis in a position immediately over said connection point, and means for disabling said stop means to allow said chassis to be lowered below said position.

15. The apparatus of claim 14 wherein said stop means comprises a component adapted to bear on the connection of said connection cable and to move in relation to said chassis between an upper position and a lower position, a hydraulic assembly for maintaining said component in said lower position, said means for freeing said stop means comprising a solenoid valve capable of being opened to free said hydraulic assembly and to allow said component to move from said lower position to said higher position.

16. The apparatus of claim 15 wherein said hydraulic device comprises thrust means for automatically bringing said component to said lower position subsequent to the opening of said solenoid valve.

* * * * *